US006190085B1

(12) United States Patent
Johansson

(10) Patent No.: US 6,190,085 B1
(45) Date of Patent: Feb. 20, 2001

(54) RAILING

(75) Inventor: Jerzy Kryszof Johansson, Hässleholm (SE)

(73) Assignee: BCC Baltic Construction Company AB, Hassleholm (SE)

( * ) Notice: Under 35 U.S.C. 154(b), the term of this patent shall be extended for 0 days.

(21) Appl. No.: 09/400,360

(22) Filed: Sep. 20, 1999

Related U.S. Application Data

(63) Continuation of application No. PCT/SE98/00503, filed on Mar. 20, 1998.

(30) Foreign Application Priority Data

Mar. 20, 1997 (SE) ..... 9701028

(51) Int. Cl.[7] ..... E01F 13/00
(52) U.S. Cl. ..... 404/6; 256/13.1
(58) Field of Search ..... 404/6, 7; 256/13.1, 256/1

(56) References Cited

U.S. PATENT DOCUMENTS

| | | | | |
|---|---|---|---|---|
| 1,600,165 | * | 9/1926 | Dennebaum | 404/6 |
| 2,349,648 | * | 5/1944 | Brickman | 256/13.1 |
| 2,907,552 | | 10/1959 | Crone . | |
| 3,233,870 | * | 2/1966 | Gerhardt | 404/6 |
| 3,258,250 | * | 6/1966 | McMullin | 256/13.1 |
| 3,276,750 | | 10/1966 | Ridder . | |
| 3,633,876 | * | 1/1972 | Irwin | 256/13.1 |
| 4,075,473 | * | 2/1978 | Winston | 256/13.1 |
| 4,330,106 | * | 5/1982 | Chisholm | 256/13.1 |
| 4,819,916 | * | 4/1989 | Wun-chung | 256/13.1 |
| 5,022,782 | * | 6/1991 | Gertz et al. | 404/6 |
| 5,641,241 | * | 6/1997 | Rushing | 404/6 |
| 5,797,591 | * | 8/1998 | Krage | 404/6 |

FOREIGN PATENT DOCUMENTS

| | | | |
|---|---|---|---|
| 27 48 957 B1 | * | 11/1977 | (DE) . |
| 1209191 | | 10/1970 | (GB) . |

* cited by examiner

*Primary Examiner*—Thomas B. Will
*Assistant Examiner*—Kristine M. Markovich
(74) *Attorney, Agent, or Firm*—Luedeka, Neely & Graham, P.C.

(57) ABSTRACT

A barrier comprises posts, an impact-absorbing rail, and a pretensioned steel cable extending in the longitudinal direction of the barrier. The steel cable is arranged in an upwardly open undercut groove in cable holders on the posts. The impact-absorbing rail has the form of a downwardly open sectional rail, which covers the steel cable and the major part of the cable holders. An elongate fibre-optic light guide is fixed to a downwardly directed surface of this impact-absorbing rail.

14 Claims, 5 Drawing Sheets

FIG.I 61
42
62
40
60
64
59
55
63
49
53
54
56
48
47
57
41
58
51
52
48
50
64
45
63
46
43
66
67
44
65

RAILING

This application is a continuation of international application Ser. No. PCTSE98/00503, filed Mar. 20, 1998.

The present invention relates to a railing or barrier, which is intended especially for roads and bridges.

Barriers of the types used for roads and bridges should be highly crash-resistant. Therefore standards for such barriers have been set by road administrations in different countries. Most standards prescribe that the barrier should have elements absorbing the impact at the same level as the hub caps, i.e. a longitudinal beam positioned on the normal level of the hub caps of the vehicles. Since passenger cars and trucks have different wheel diameters, these elements must have a considerable vertical extent. The most common construction therefore is an impact-absorbing profiled metal sheet of European standard. This profiled metal sheet usually has two longitudinal ridges and an intermediate groove. The heads of the mounting bolts are arranged in this groove so as not to immediately touch vehicles sliding along the barrier. This type of barriers functions excellently as impact-absorbing elements but are unfavourable since they block the view. This is a particularly great disadvantage of bridge barriers especially in urban and motorway environments since vehicles approaching a crossing adjacent the end of the barrier are in many cases difficult to see. Also for aesthetical reasons, a clearer view should be preferred, above all in areas much frequented by tourists. It has therefore been suggested that this impact-absorbing profiled metal sheet be divided into individual impact-absorbing rods or tubes. Changing to such impact-absorbing elements, however, causes an additional problem since the road administrations in different countries require that the surface of the barrier facing the pavement be smooth and have no extensible mounting elements. As examples of this technique mention can be made of GB-A-1,209,191, GB-A-1,417,109, GB-A-2,266,910, U.S. Pat. No. 3,276,750, FR-A-2,698,643 and WO 88/00628.

With a view to improving the strength and increasing the crash resistance of road and bridge barriers, it has also been suggested that the individual impact-absorbing rods or tubes be replaced by steel cables or that steel cables be inserted in through holes in the individual impact-absorbing rods or tubes. Road fencing having bare steel cables is frequently used along motorways, whereas U.S. Pat. No. 2,907,552 can be mentioned as an example of road fencing and bridge barriers, in which the steel cables are enclosed in longitudinal tubes.

Bare steel cables are approved by the road administrations for road fencing between roadways, but not as bridge barriers. This depends on the fact that the cables often yield outwards when subjected to impact, such that in difficult cases the vehicle can temporarily move upwards almost one metre past the original position of the steel cables in their non-affected state. When the steel cables are fully enclosed in tubes as is the case in the above-mentioned U.S. Pat. No. 2,907,552, this outward flexing is reduced to a considerable extent or fully eliminated. A further reason why it is preferred to have the cables fully enclosed in a protective tube is that unprotected cables when subjected to impact mill or cut the body of the crashing vehicle open. Precisely this effect of unprotected cables has made many road administrations completely ban the use of unprotected cables on levels above the normal level of hub caps. An unprotected cable at the upper edge of a bridge barrier of normal height could cause severe personal injuries since the cable in that case would be on a level with the windows of passenger cars.

To enable the use of steel cables also at levels above the normal level of hub caps, U.S. Pat. No. 2,907,552 has suggested a road or bridge barrier with specially designed posts having laterally directed U-shaped cable mountings, which besides serve as mountings for the mounting of U-shaped impact-absorbing rods.

The prior-art road fencing with fully enclosed steel cables certainly has great advantages over road fencing with bare steel cables, but also suffers from a considerable drawback. They are difficult and, thus, expensive to mount since the steel cables must be passed through the tubes and only after that be subjected to tensile prestress.

The known road fencing according to U.S. Pat. No. 2,907,552 is advantageous compared with road fencing with fully enclosed steel cables since the cables can be mounted separately in their cable mountings before the U-shaped covers or impact-absorbing rods are pushed sideways over the holders and fixed by means of bolts. A problem with the barriers or road fencing according to the last-mentioned US patent specification is, however, that the U-shaped covers or impact-absorbing rods and their fixing bolts must be mounted before the cables are tensioned, at least in connection with fencing through curves, where the fencing is positioned along the side where the cable is located on the concave side of the road fencing. In this prior-art construction, the fixing bolts for the longitudinal U-shaped covers or impact-absorbing rods in fact hold the cables in the cable mountings. Another problem of this known construction is that the holes in the longitudinal U-shaped covers must be bored in a workshop or, in most cases, on the occasion of mounting since the distance between the rods is not always exactly according to the specifications. Since the fixing bolts for the U-shaped covers also serve as fixing means for the steel cables, it is not sufficient to use merely the steel cables as temporary barriers during the building time. It is in fact an imperative labour safety requirement that at least temporary barriers are erected during this time.

If a protective barrier according to U.S. Pat. No. 2,907,552 is subjected to a light crash, which after all is most common, the steel cable is in most cases intact whereas the U-shaped protective sectional element must be replaced. If the barrier is arcuate along the concave side of a curve, the above problems arise since the fixing bolts serve to hold the steel cable sideways.

A further drawback of this prior-art construction is that the steel cables are subjected to the weather and, which is most serious, also to road salt when the opposite roadway is being cleared of snow. It is true that the steel cable can be protected with a plastic layer, but since the steel cable is not protected against sunlight from all directions, the service life of the plastic protective layer is affected.

Prior-art road fencing and barriers thus suffer from different kinds of drawbacks. An object of the present invention therefore is to provide a new barrier, in which these drawbacks have been obviated or, in any case, reduced to a considerable extent.

A further object of the invention is to provide a new barrier, in which the need of making holes adjacent to post mountings is obviated, such that the need of preparation at the working site is reduced to a minimum.

A further object of the present invention is to provide a barrier, whose impact-absorbing elements consist of one or more longitudinal, pretensioned steel cables and in which these cables can be rapidly mounted on the posts of the barrier and be tensioned to serve as temporary protection before the other barrier components are mounted.

One more object of the invention is to provide a barrier, which has longitudinal, pretensioned steel cables as principal impact-absorbing elements and in which these steel cables are essentially protected against the effect of sunlight and road salt.

Another object of the invention is to provide a barrier, which owing to its construction can be easily supplemented with an elongate fibre-optic light guide or light-emitting diode which is adapted to serve as road marking and which is protected against damage in connection with the clearing of snow and other road maintenance.

According to the invention, these and other objects are achieved if the barrier is designed as defined in the independent claim. The dependent claims define particularly preferred embodiments of this invention.

Summing up, the invention thus lies in a barrier having posts, at least one impact-absorbing rail extending therebetween and at least one pretensioned steel cable extending over the entire length of the barrier or at least over a major part of the length of the barrier. According to the invention, this steel cable is placed in an upwardly open, undercut groove in cable holders on the posts, and the impact-absorbing rail is formed as a downwardly open sectional rail, which from above and sideways covers the steel cable and, in any case, the major part of the cable holders.

A few preferred embodiments of a barrier according to the present invention will now be described in more detail with reference to the accompanying drawings.

Figure 1:
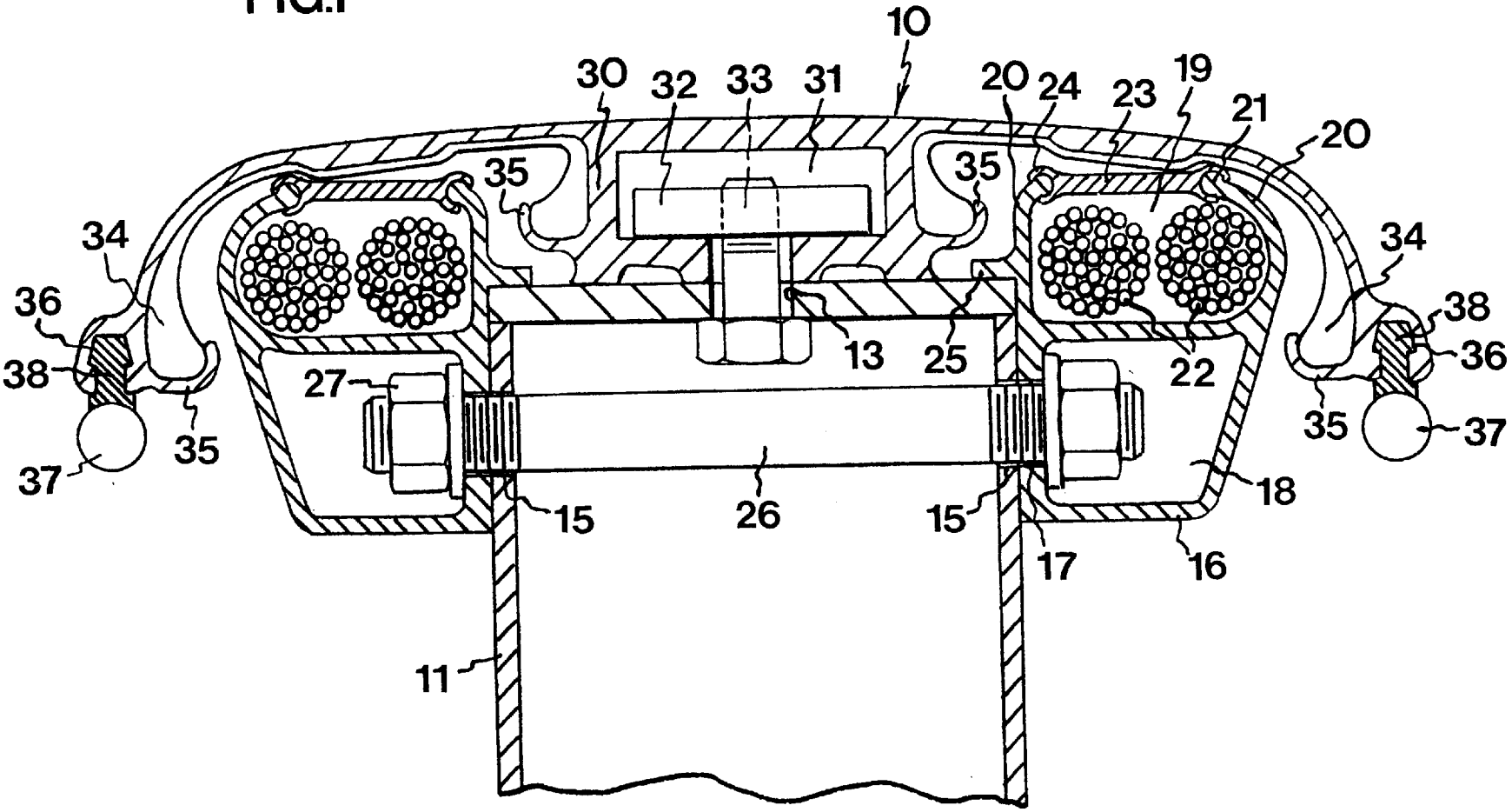
FIG. 1 is a sectional view of a central barrier which is formed according to the present invention.
Figure 2:
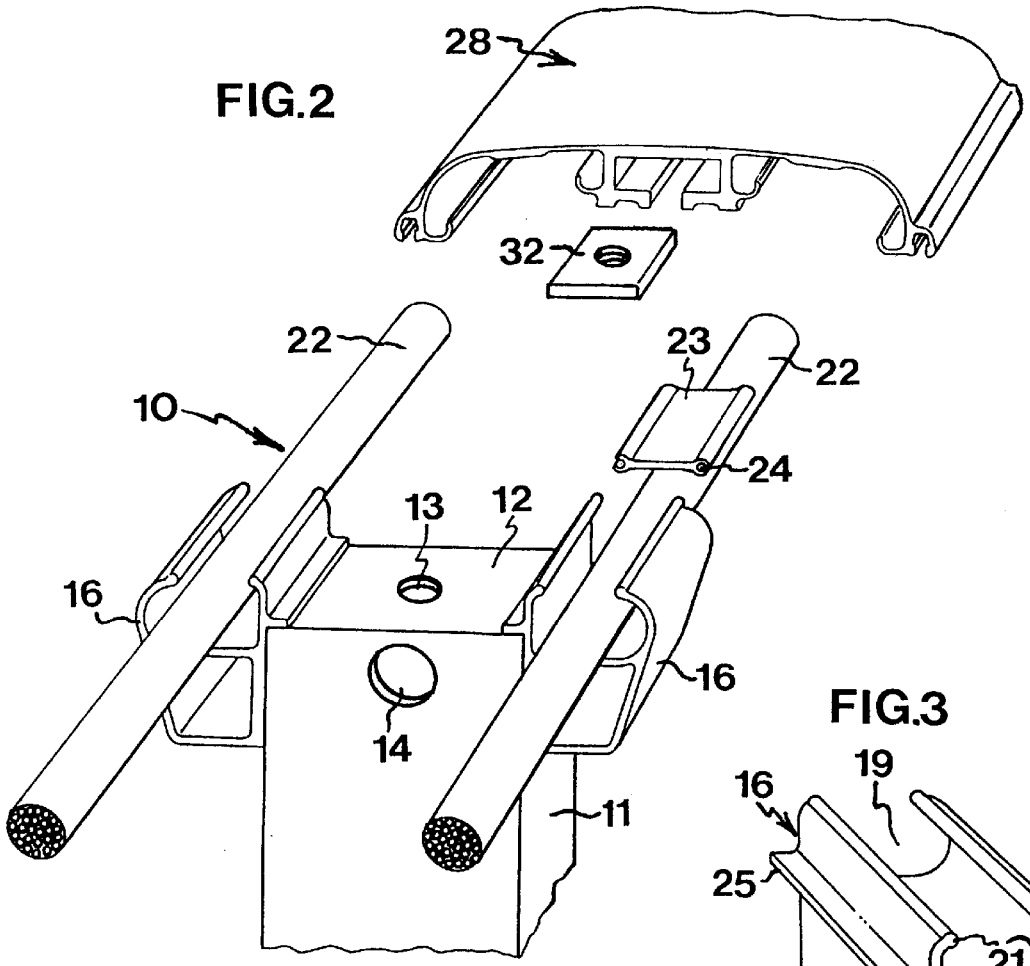
FIG. 2 is a perspective view for illustrating the mounting procedure when mounting the central barrier according to FIG. 1.
Figure 3:
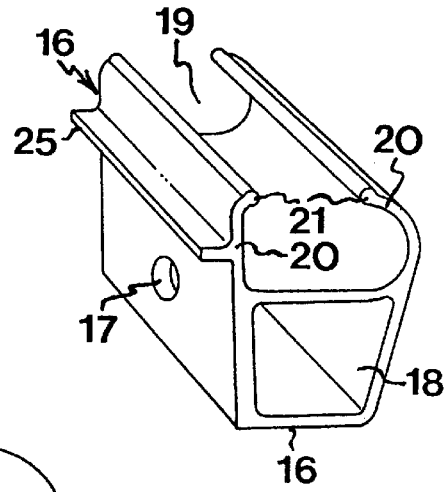
FIG. 3 is a perspective view of a cable holder included in this central barrier.
Figure 4:
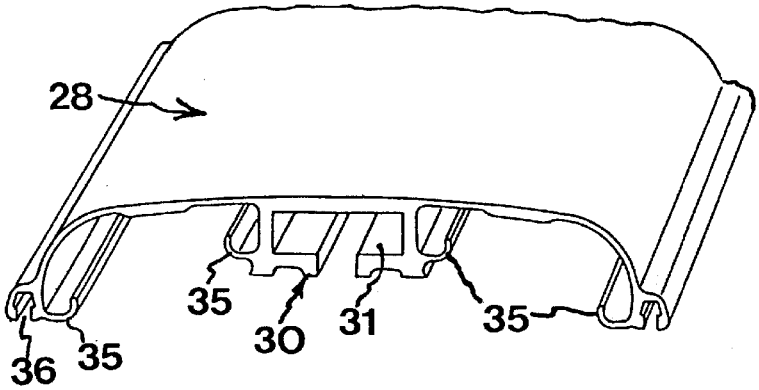
FIG. 4 is a perspective view of a sectional cover bar included in the same central barrier.
Figure 2A:
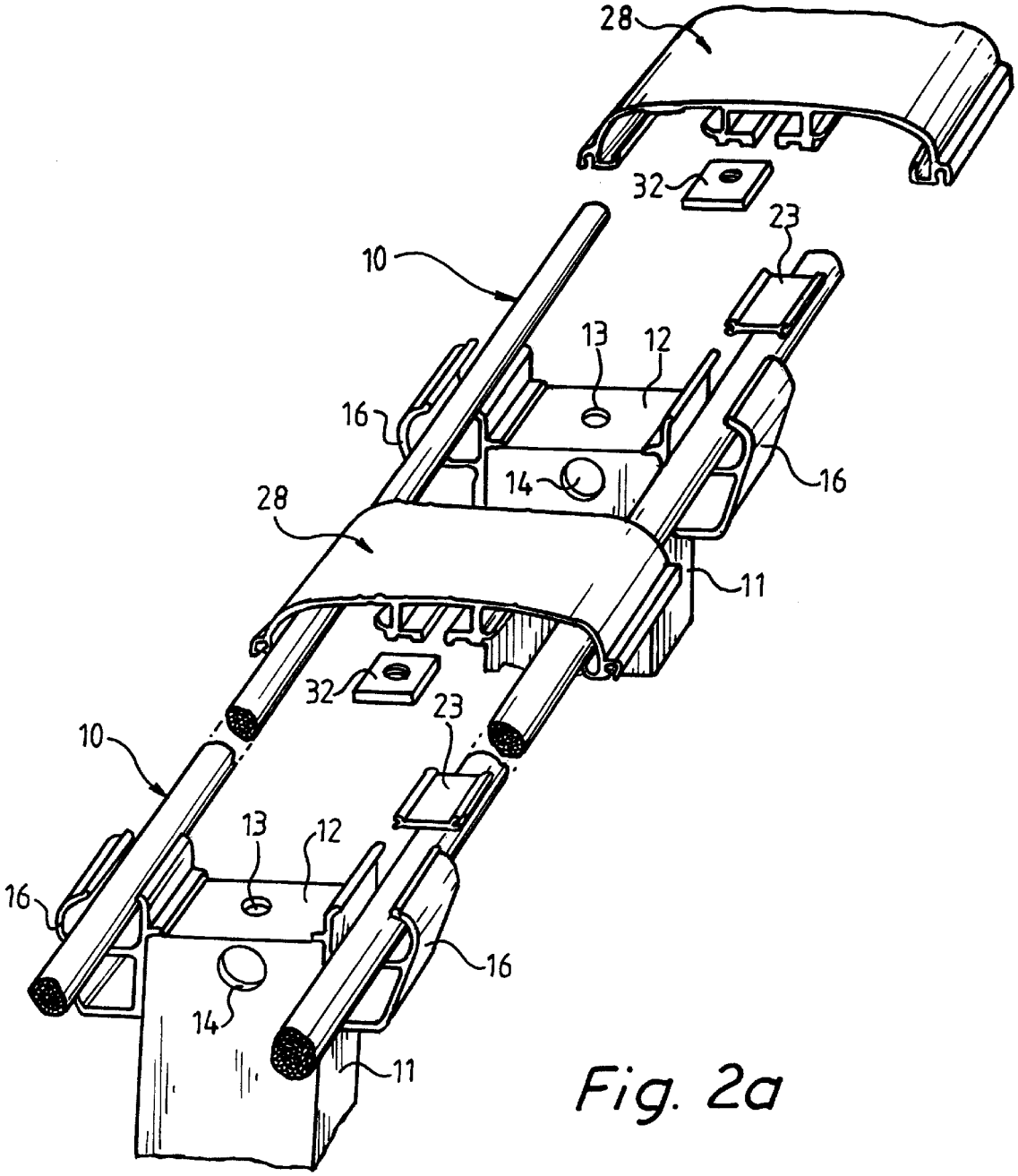
FIG. 2A is a perspective view illustrating a plurality of posts and barriers according to the present invention.

FIGS. 1–4 show an example of the invention. In this case the barrier is formed as a central barrier 10. The barrier comprises a number of posts 11, which are positioned along the road and which at their upper end have a transverse plate 12 with a mounting hole 13. Adjacent to the upper end of the posts there are also a mounting hole 14 and a through mounting hole 15. Cable holders 16 are mounted on each side of the post. Their length in the longitudinal direction of the railing or barrier is suitably the same as the width of the posts 11. These cable holders have a mounting hole 17 and a projecting supporting flange 25. The supporting flange is adapted to be arranged against the upper side of the plate 12 to facilitate correct alignment of the hole 17 with the hole 15 of the post. The cable holder 16 has a lower through duct 18 and an upwardly open upper groove 19 with inwardly bent edge flanges 20, such that the groove forms an undercut groove. The edge flanges 20 have a thickened outer edge portion 21. In the upwardly open groove 19 of the cable holders, one or more steel cables 22 are arranged. The steel cables are pretensioned in the usual way so as to be subjected to tensile stress. By the groove being undercut, the steel cables are prevented from sliding out of the groove when subjected to lateral load. In order to further secure the steel cable or cables, the groove 19 of the cable holder is closed with a locking plate 23, which at its ends has undercut grooves 24 for cooperation with the thickened edge portions 21 of the edge flanges 20. This means that rapid mounting of the steel cables is possible, such that they can serve as temporary protection during the continued work on the road or bridge where the barrier is to be mounted, and such that the mounting of the other parts of the barrier can be carried out as finalising work in connection with the final work on the road or bridge structure.

The two opposite cable holders 16 are held in place on the post 11 by means of a stud bolt 26 passed through the hole 15 and a nut 27.

According to the invention, this barrier also comprises a cover member 28. This has the form of a sectional bar injection-moulded of aluminium and forming two downwardly open grooves. In the mounted state, these enclose the steel cables and the upper part of the cable holders and, consequently, protect the steel cables from sunlight and other environmental effects, e.g. splashes of snow slush mixed with salt. The cover member has in its central portion a mounting flange 30 with a downwardly open undercut groove 31. In this groove, the required number of threaded clamping blocks 32 are inserted, which are moved along the groove so as to be positioned opposite to the mounting hole 13. A bolt 33 is then passed through the mounting holes 14 and 13 and screwed into the clamping block for clamping of the cover member 28. Alternatively, T bolts can be used instead of the clamping blocks 32 and the bolts 33.

For the lengthening of the cover member 28, use is made of extension pieces 34, which are introduced into the end portions of adjoining cover members on both sides of the mounting flange 30 and are held in place by means of arcuate, inwardly directed holding flanges 35 on the underside of the cover member. FIG. 1 is an end view of these two extension pieces.

In this particularly preferred embodiment of the invention, the cover member has downwardly directed undercut grooves 36 adjacent to its outer edge. These grooves serve as fixing grooves for a fibre-optic cable or light guide 37, which is joined with a longitudinal holding flange 38. The light guide 37 is in turn connected to a low voltage light source (not shown) to make it possible to turn on the cable in case of poor light conditions or in the dark. Current can be supplied to the light source by the means via a transformer or from a battery.

By the light guide 37 being fixed on the underside and preferably at a certain distance from the outer edge of the cover member, the cable is protected against damage in connection with e.g. snow-clearing work on the neighbouring roadway.

If the central barrier is high, it is possible to mount below the cover member additional impact-absorbing rods, for instance, those described in connection with FIGS. 5 and 6.

Figure 5:
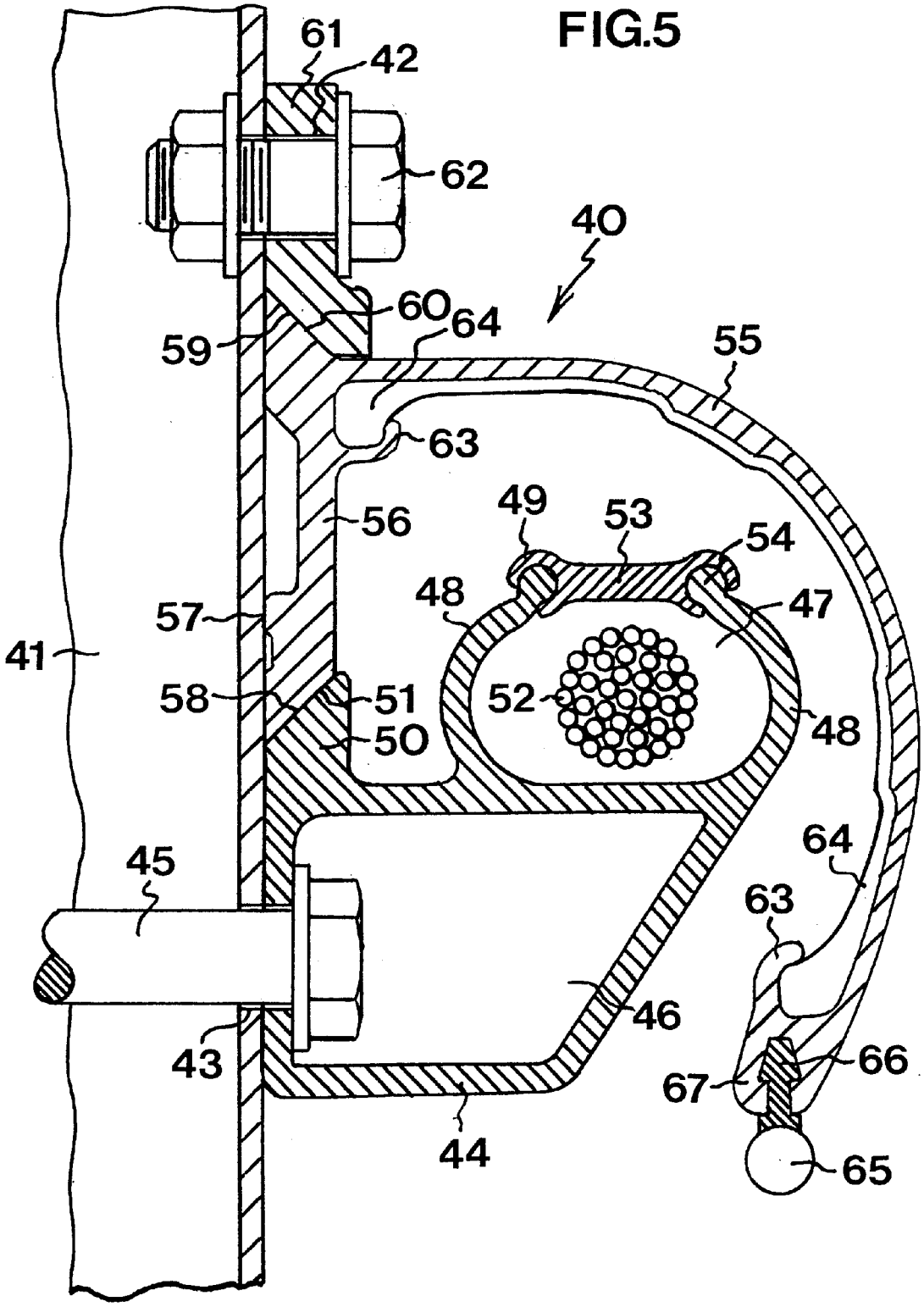
FIG. 5 shows an example of a side barrier according to the present invention.

FIG. 5 shows an example of a side barrier 40 according to the invention. Only one impact-absorbing rod is shown, but it will be appreciated that a plurality thereof can be arranged on different levels along the posts.

The barrier 40 comprises a number of posts 41, of which only one is shown. The posts have mounting holes 42 and 43 at their upper end. The distance between the mounting holes is adjusted to the other parts of the barrier. A cable holder 44 is fixed to the post by means of a bolt 45, which is screwed into the lower mounting hole 43. Also in this case, the length of the cable holder in the longitudinal direction of the barrier is approximately the same as the thickness of the post.

The cable holder 44 has a lower through duct 46 and an upwardly open groove 47 with inwardly bent lateral flanges 48 for forming an undercut groove. The lateral flanges are terminated with a thickened edge portion 49.

At its side closest to the post 41, the cable holder has an upwardly projecting flange 50, which has a bevelled edge surface 51. One or more steel cables 52 are arranged in the groove 47. The steel cables are in the state of use pretensioned in conventional manner. In order to completely enclose the cables and hold them safely in the groove 47, the groove has been closed with a locking plate 53 with undercut grooves 54 at its terminal edges. These grooves engage with the thickened edge. portions 49.

A lateral impact-absorbing rod 55 is arcuate and has dimensions, such that after mounting it will cover, from above and from both sides, the steel cable 52 and also the major part of the groove 47, thereby protecting the steel cable against sunlight and from being otherwise affected by the environment.

The lateral impact-absorbing rod 55 has a mounting flange 56, which in mounting is pressed against the post 41. On its side facing the post, the mounting flange has a projecting rib 57. This rib ensures that the lower bevelled surface 58 of the mounting flange 46 is pressed against the bevelled edge surface 51 of the cable holder 44, thereby causing a reliable holding. The mounting flange 56 also has an upper bevelled surface 59. This cooperates with a bevelled surface 60 of a mounting clamp 61 which is screwed into the upper mounting hole 42 in the post 41 by means of a bolt 62. In the clamping operation, the mounting flange will be slightly deformed when pressing the rib 57 against the post while at the same time the two bevelled surfaces 51, 58 are pressed firmly against each other. Owing to the direction of bevel of the surfaces 59, 60, a downwardly directed force is obtained for safe holding of the lateral impact-absorbing rod 55.

To permit lengthening of the lateral impact-absorbing rod 55, it has inwardly projecting holding flanges 63 for cooperation with an extension piece 64, which is shown in an end view in FIG. 5.

Also in this preferred embodiment of a side barrier, use is made of a fibre-optic cable or light-emitting diode cable 65, which has a longitudinal holding projection 66 and is by means thereof mounted in a downwardly directed holding groove 67 at the lower edge of the lateral impact-absorbing rod 55. The holding projection 66 has a thickened edge portion for engaging by snap action with the corresponding complementary enlarged portion at the inner end of the holding groove 67. Such positioning implies that the risk of unintentional damage to the cable 65 is small in connection with snow-clearing work or other types of road work.

Figure 6:
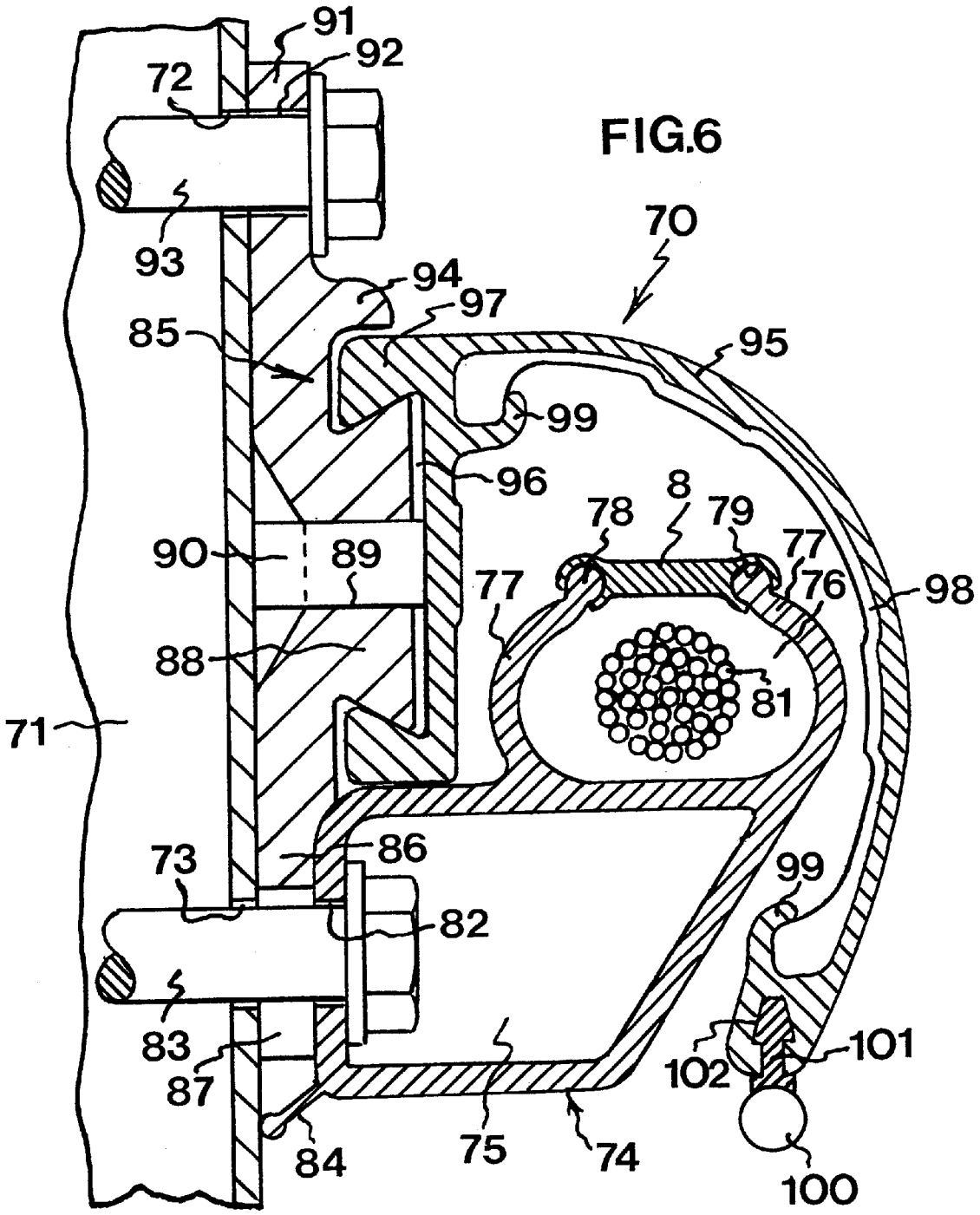
FIG. 6 shows another example of a side barrier according to the present invention.

FIG. 6 shows another example of a side barrier 70 according to the present invention. This barrier bears great resemblance with the barrier in FIG. 5, but the mode of mounting is different. The barrier comprises a number of posts 71, of which only one is shown. The post has upper and lower mounting holes 72, 73.

A cable holder 74 has a through lower duct 75 and an upwardly open upper groove 76. The lateral flanges 77 of the groove are inwardly bent to make the groove form an undercut groove. The free edges of the flanges 77 have a thickened portion 78 for cooperation with undercut grooves 79 at the ends of a locking plate 80. In the groove, one or more steel cables 81 are enclosed so as to be held in place by the flanges 77 and the locking plate 80.

In its side facing the post 71, the cable holder 74 has a mounting hole 82, through which a fixing bolt 83 is passed. The fixing bolt is screwed a distance into the lower mounting hole 73 of the post. At the lower edge of the cable holder there is a flange 84 which projects obliquely downwards to the post. This flange is adapted to hold the cable holder 74 away from the post 71 to make it possible to position a mounting 85 to allow mounting on the post.

The mounting 85 has a downwardly projecting flange 86 with a downwardly directed U-shaped recess 87, such that the flange 85 can be passed downwards between the cable holder 74 and the post 71 and be held by the bolt 83 during mounting of the remaining parts of the side barrier.

In the central portion of the mounting 85 there is a dovetail mounting flange 88. This has a through hole 89, in which a pressure pin 90 is inserted. At the other end of the mounting 85 there is an upwardly projecting flange 91 with a mounting hole 92. A fixing bolt 93 is passed through this hole and screwed into the upper fixing hole 72 of the post.

On the outside of the mounting 85 there is a projecting flange 94, which together with the dovetail projection 88 forms a groove for a purpose that will be described below.

The side barrier also comprises a lateral impact-absorbing rod 95, which is arcuate so as to form in its mounted state a downwardly open groove, in which the steel cable 81 is positioned to be protected against sunlight and from being otherwise affected by the environment. The rod 95 has a dovetail mounting groove 96 for cooperation with the corresponding mounting flange 88 of the mounting 85.

In the mounting operation, the mounting 85 is temporarily fixed to the rod 95 by the upper flange 97 of the rod 95 being passed downwards between the flanges 94 and 88. Subsequently, the pin 90 is inserted. This pin is somewhat longer that the distance between the surface of the mounting 85 abutting against the post 71 and the end surface of the dovetail flange 88 facing away from the post. By this arrangement, the pressure pin 90 will press the impact-absorbing rod 95 outwards away from the post when the bolts 93 and 83 are tightened. This results in a reliable joint between the mounting and the impact-absorbing rod. When the lower bolt 83 is tightened to clamp the flange 86, the flange 84 of the cable holder will be pressed against the post and in this connection be bent depending on how much it has originally projected from the cable holder.

Like in the embodiments according to FIGS. 1 and 5, use is made of an extension piece 98 for lengthening the rod 95. To this end, the rod has inner flanges 99 for cooperation with the extension piece 98. Moreover, use is also in this case made of an elongate fibre-optic light. guide or light emitting diode 100 with a mounting projection 101 for cooperation with an undercut mounting groove 102 in the underside of the free terminal edge of the impact-absorbing rod 95.

What is claimed is:

1. A barrier for placement adjacent a roadway to limit movement of a vehicle off the roadway, the barrier comprising a plurality of generally upright, spaced-apart posts, at least one elongate, generally horizontally disposed sectional impact-absorbing rail extending therebetween, and at least one pretensioned, elongate steel cable at least portions of which are arranged and received in open grooves in cable holders supported on the posts, wherein the grooves of the cable holders are closed with a removable looking plate so as to limit displacement of the cable out of the grooves of the cable holders and wherein the rail is dimensioned and arranged in relation to the roadway and the cable holders so as to cause the rail to cover and protect the steel cable from a direct impact thereagainst by a vehicle coming into contact with the barrier from the sides or from above the barrier.

2. The barrier as claimed in claim 1, wherein the grooves associated with the cable holders open generally upwardly.

3. The barrier as claimed in claim 1, wherein the rail includes a dovetail flange having a relatively wider end that faces the post, the flange having a beveled surface fittingly engageable with a surface on the cable holder and a further beveled surface engageable with a corresponding surface of a mounting clamp, wherein the dovetail flange includes a ridge projecting outside an end surface thereof.

4. The barrier as claimed in claim 1, wherein the rail includes a dovetail mounting groove facing the post and the barrier further comprises a post mounting which includes a dovetail mounting flange projecting therefrom and end flanges, wherein the cable holder in its mounted state abuts against at least one end flange so as to urge the flange against the post and support the rail on the mounting flange.

5. The barrier as claimed in claim 4, wherein the post mounting includes a supporting flange that projects adjacent the dovetail mounting flange and abuts against the rail.

6. The barrier as claimed in claim 1, wherein the rail on a downwardly directed surface thereof includes a mounting groove for receiving an elongate light guide or light-emitting diode which is connected or connectible to a source for energizing the guide or diode to cause the same to produce visible illumination.

7. A roadside barrier system for limiting movement of a vehicle off a roadway or area adjacent a roadway which comprises a generally upright support post, at least one generally horizontally disposed impact-absorbing rail supported on the post, and a cable holder supported on the post adjacent the rail including an open groove for confinably receiving at least a portion of the length of an elongate cable therethrough and a removable locking plate closing the groove, the rail being dimensioned and positioned so as to substantially cover the cable to protect the cable against the elements and to limit direct impact against the cable by a vehicle moving against the barrier system from the roadway or an area adjacent the roadway.

8. The barrier system according to claim 7, further comprising a plurality of said posts spaced-apart from one another, the rail being provided by segmented, arcuate shaped members interengageable with each other at their adjacent, abutting ends and spanning between adjacent posts, wherein the rail is positioned such that the arcuate shape thereof aids in deflecting a vehicle contacting the barrier system.

9. The barrier system according to claim 7, wherein the cable holder and associated rail are disposed adjacent the top of the post so that the cable is supported adjacent the upper end of the post.

10. The barrier system according to claim 7, wherein the cable holder and associated rail are disposed adjacent a side of the post so that the cable is supported adjacent the side of the post spaced downwardly from the top of the post and sufficiently above the adjacent road surface or area adjacent a roadway such that the rail is positioned to substantially engage a side, front, or rear portion of a vehicle as opposed to engaging only or substantially only the wheel, wheels or chassis thereof.

11. The barrier system according to claim 7, wherein the groove is undercut to limit undesired movement of the cable out of the groove.

12. The barrier system according to claim 11, wherein the cable is pretensioned.

13. The barrier system according to claim 7, wherein a portion of the cable holder substantially covers the cable and is positioned generally intermediate the cable and the rail so that said portion of the cable holder and the rail both protect the portion of the cable received in the cable holder the against direct impact by a vehicle.

14. The barrier as claimed in claim 4, wherein the dovetail mounting flange of the post mounting includes an opening for receiving a pressure pin having a length greater than the thickness of the post mounting perpendicular to the post length and which, in the mounted state of the rail upon the post, is urged against the bottom of the dovetail groove of the rail to increase the force of engagement between adjacent surfaces of the mounting flange and the dovetail groove.

* * * * *